US005099580A

United States Patent [19]

Stegall et al.

[11] Patent Number: 5,099,580

[45] Date of Patent: Mar. 31, 1992

[54] POWER SAW STRUCTURE

[75] Inventors: Robert S. Stegall, Mundelein, Ill.; Sigeru Sato, Sayama, Japan

[73] Assignees: Echo Incorporated, Lake Zurich, Ill.; Kioritz Corporation, Japan; part interest to each

[21] Appl. No.: 111,504

[22] Filed: Oct. 22, 1987

[51] Int. Cl.[5] ..... B27B 17/08

[52] U.S. Cl. ..... 30/383; 30/371

[58] Field of Search ..... 30/371, 383, 381, 382, 30/514; 83/745

[56] References Cited

U.S. PATENT DOCUMENTS

| | | | |
|---|---|---|---|
| 2,777,482 | 1/1957 | Chamberlain et al. | 30/371 |
| 2,948,310 | 8/1960 | Herron | 30/371 |
| 3,823,474 | 7/1974 | Ionescu | 30/383 |
| 3,849,883 | 11/1974 | Kolorz | 30/381 |
| 3,864,830 | 2/1975 | Haddon | 30/371 |
| 4,041,606 | 8/1977 | Thompson | 30/381 |

FOREIGN PATENT DOCUMENTS

| | | | |
|---|---|---|---|
| 2098272 | 11/1982 | United Kingdom | 30/383 |

*Primary Examiner*—Frank T. Yost
*Assistant Examiner*—Rinaldi Rada
*Attorney, Agent, or Firm*—Wood, Phillips, VanSanten, Hoffman & Ertel

[57] ABSTRACT

A power saw structure having a pivot provided on a forward lower portion of the housing of the drive for providing a fulcrum on a subjacent surface about which the saw structure may be pivoted so as to safely urge the forward distal end of the saw chain into the subjacent surface while maintaining the chain saw structure supported on the subjacent surface through the pivot. In the illustrated embodiment, the pivot structure is a separate structure secured to the housing of the drive. The pivot structure includes an upwardly extending forward portion for supporting the saw structure on the subjacent surface throughout the full range of swinging movement of the saw in cutting through the subjacent surface.

4 Claims, 1 Drawing Sheet

FIG. 1
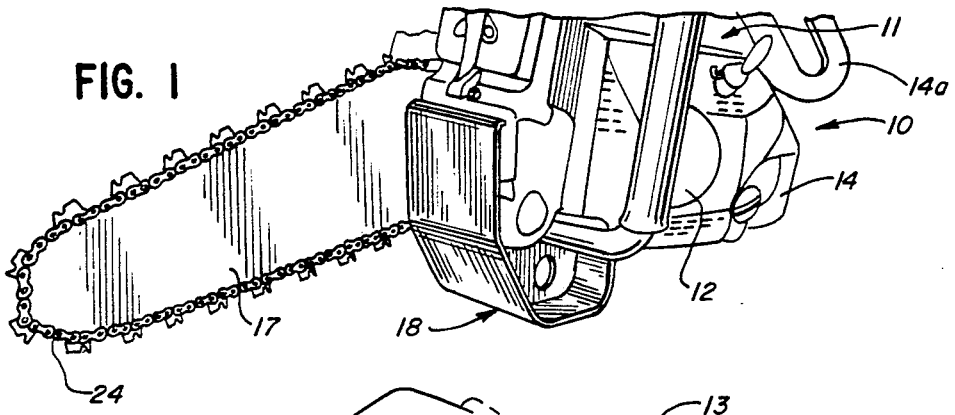
FIG. 2
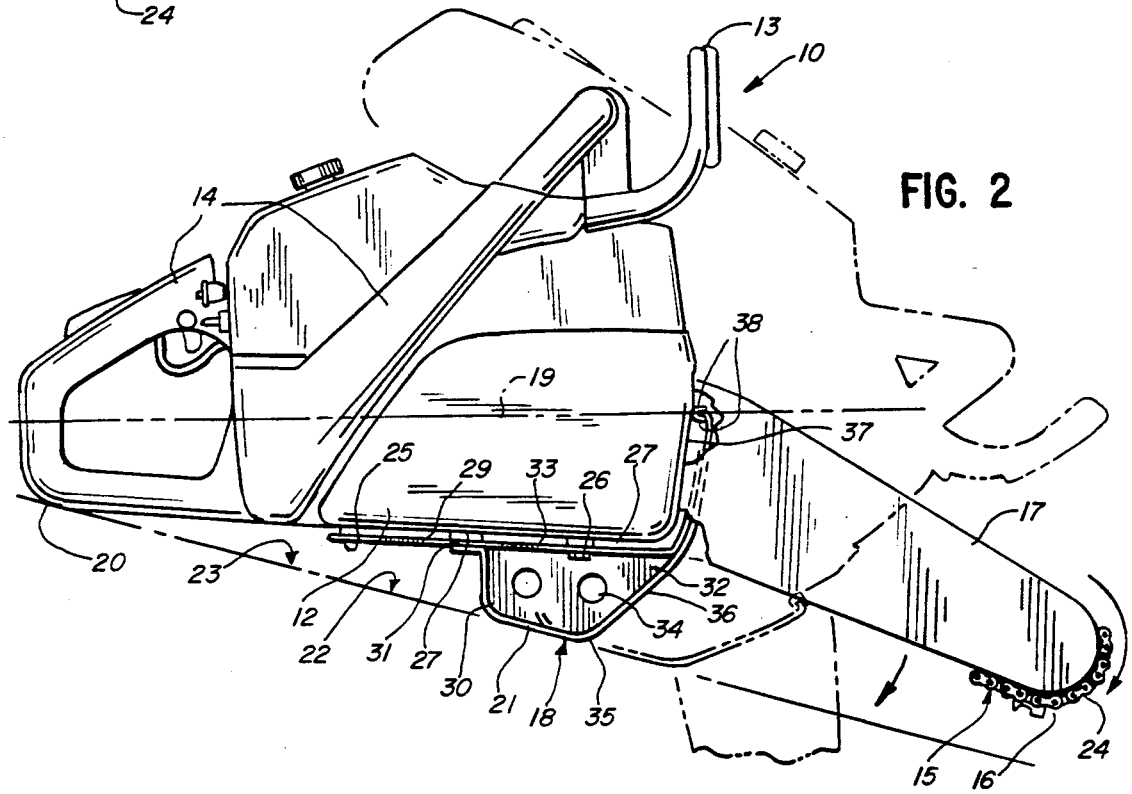
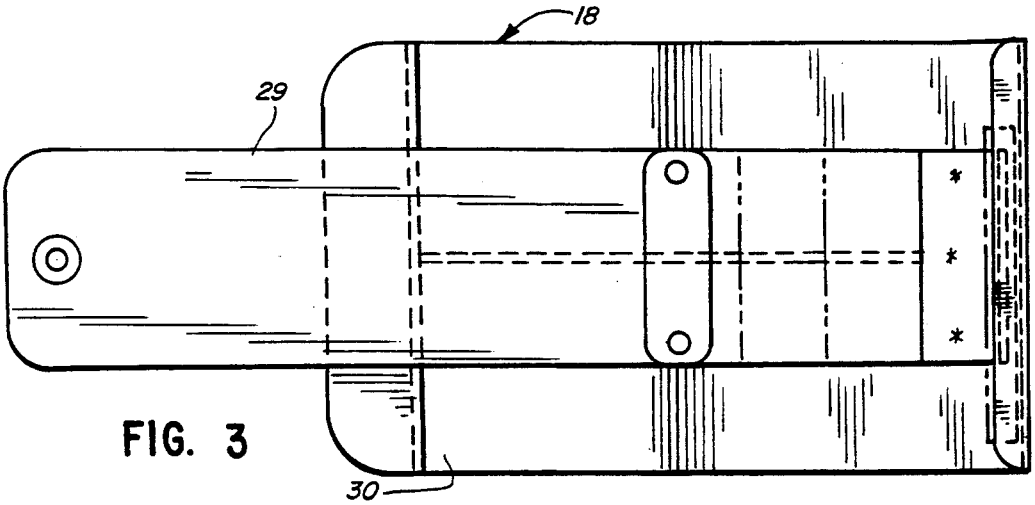
FIG. 3

POWER SAW STRUCTURE

TECHNICAL FIELD

This invention relates to power saw structures and in particular to power chain saws.

BACKGROUND ART

In one form of conventional chain saw, the chain carrying the cutting elements moves about a forwardly extending bar. The bar is cantilevered from a power drive which may comprise an engine or an electric motor, as desired. The power drive conventionally includes an outer housing having one or more handles for manipulating the chain saw in the use thereof.

A problem arises when such a chain saw is utilized to initiate a cut through a wall surface, and the like. Such use is often required by firemen and the like, such as for cutting through a roof in order to gain access to or ventilation of the subjacent space.

In using the conventional chain saw for this purpose, the operator must attempt to urge the chain at the distal end of the bar downwardly through the roof surface portion. Such use of the chain saw is dangerous in that the chain may slip on the roof surface or tend to walk about prior to gaining purchase in the roof.

Further, existing chain sawing equipment does not lend itself to safe operation when used to cut through roofs and the like. Existing roof structures may be sloped up to 45°. A fireman must put himself often in an unsafe and awkward position on such sloping surfaces to stabilize himself. In addition, existing power saws cannot be set on the roof to facilitate their use in gaining access. They must be held in dangerously awkward positions in order to complete the task properly.

Resort has been had to initiating a cut through such a roof surface by means of an axe or similar initial penetrating tool. When the opening in the roof thusly formed is of sufficient size to pass the bar-carried chain downwardly therethrough, the user may then use the chain saw in the normal manner in effecting an enlargement of the opening. The axe is often used to make the entire vent hole. This method is time-consuming and the time the fireman must spend on the roof of a burning structure presents a serious safety problem.

Such a procedure has the serious disadvantages of requiring a plurality of different tools and is relatively slow in effecting the desired entrance opening.

DISCLOSURE OF INVENTION

The present invention comprehends an improved power saw structure having means for automatically guiding the extended saw chain downwardly through a surface on which the saw structure is placed so as to quickly initiate an opening through the surface portion in a safe manner.

More specifically, the invention comprehends the provision of a powered saw structure having an associated pivot means adapted to be placed on a portion of the surface to be cut through. The pivot means is arranged to permit the saw chain carried on the bar to be swung downwardly against and into the subjacent surface on which the saw structure is placed by a simple pivoting movement of the saw structure about the pivot means.

The pivot means is extended upwardly along the front surface of the drive portion of the saw structure so as to permit a controlled pivoting or swinging of the saw structure from an initial position generally parallel to the surface to a final position wherein the bar-carried chain may extend substantially perpendicularly therethrough.

In addition, the pivot front surface is designed so as to facilitate the guiding of the bar and chain back through the cut. This allows the fireman to maintain his arms in a more comfortable position, by pivoting the bulk of the weight of the saw to be supported by the subjacent structure.

In the illustrated embodiment, the pivot means comprises a pivot structure fixedly secured to a forward lower portion of the housing of the drive means.

The pivot structure, in the illustrated embodiment, is resiliently mounted to the housing of the drive for further improved controlled pivoting of the saw structure in use.

The chain bar is caused to extend forwardly and downwardly at a preselected small angle to the normal horizontal axis of the drive so as to facilitate the introduction of the distal end of the chain into the subjacent surface.

In the illustrated embodiment, the chain bar extends at an angle of approximately 25° to the axis of the drive.

The drive means housing defines a rear portion which cooperates with the depending pivot means to define a base line extending at a preselected small angle to the axis of the drive.

The base line is disposed so as to cause the distal end of the chain, on the forwardly projecting bar, to be spaced a small distance above the base line, and thus, the supporting surface, when the saw structure is disposed with the rear portion of the housing and the bottom of the pivot resting on the subjacent surface.

Thus, the user may simply place the saw structure on the surface to be cut through, whereby the distal end of the chain will automatically be disposed closely adjacent that surface forwardly of the pivot. Resultingly, the user may then simply pivot the saw structure about the pivot, raising the rear edge portion of the housing upwardly and lowering the distal forward end of the chain into the subjacent surface, thereby initiating the cutting through of the supporting surface portion in a simple and safe manner.

The novel structure of the saw further allows for safe starting of the saw by permitting it to be rested on the subjacent surface during the starting operation.

The illustrated pivot means comprises a formed sheet metal structure. A forward portion of the sheet metal structure extends forwardly of the drive housing so as to support the saw structure throughout the range of pivoting from the initial position discussed above to a final position wherein the bar and chain carried thereon may extend substantially perpendicularly through the subjacent surface portion.

The forwardly downwardly angled disposition of the chain bar facilitates the introduction of the chain to the subjacent surface portion and further facilitates the use of the saw structure in further cutting through the subjacent wall, or roof, following the full penetration of the saw chain through the roof, thereby facilitating further enlargement of the opening rapidly and safely.

The saw structure of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a powered saw structure embodying the invention;

FIG. 2 is a side elevation thereof, with the pivoted arrangement of the chain saw extending generally perpendicularly through the subjacent surface shown in broken lines; and FIG. 3 is a plan view showing the pivot means of the invention in greater detail.

BEST MODE FOR CARRYING OUT THE INVENTION

In the illustrated embodiment of the invention as disclosed in the drawing, a power saw structure generally designated 10 is shown to comprise a powered drive generally designated 11 having an outer housing 12 provided with a hand guard 13, manipulating handles 14 for use in manipulating the saw structure, and a starter handle 14*a* for use in starting the saw. Starter handle 14*a* is made substantially larger than the conventional starter handle to permit facilitated grasping thereof notwithstanding use of gloves by the operator.

A conventional chain 15 having cutting elements 16 is movably carried peripherally on a forwardly projecting support bar 17 for effecting a chain saw cutting action by the urging of the chain against the surface to be cut.

The present invention is concerned with the provision of a pivot means generally designated 18 on the housing 12. Additionally, the invention comprehends the arrangement of the support bar 17 so as to extend forwardly and downwardly at a small angle to the fore-and-aft axis 19 of the drive 11. In the illustrated embodiment, the bar extends at an angle of approximately 25° to the axis 19.

As further illustrated in FIG. 2, drive housing 12 defines a lower rear edge portion 20. Pivot 18 defines a bottom portion 21 which, cooperatively with rear edge portion 20, defines a base line 22 extending angularly forwardly and downwardly relative to drive axis 19. Thus, when the saw structure is placed on a subjacent surface, such as surface 23, defining the upper surface of a roof or the like, the forward distal end 24 of the chain on bar 17 is spaced a small distance above the surface 23.

The length of saw 17 is preferably shorter than approximately 12" so as to preclude excessively deep cutting and damage of the main supports of roof structures. This facilitates and speeds the cutting and minimizes the damage to facilitate subsequent repair in the event the fire is put out.

In the illustrated embodiment, pivot means 18 comprises a pivot structure fixedly secured to the housing 12 by suitable means, such as screws 25 and 26. Resilient pads 27 and 28 are associated with the pivot structure for resiliently mounting this structure to the housing.

More specifically, as seen in FIGS. 2 and 3, the pivot structure 18 comprises a pair of formed sheet metal elements 29 and 30, which are rigidly secured to each other as by welds 31. Further, a stiffening element 32 extends perpendicularly between the elements 29 and 30 and is welded thereto by suitable welds 33. As seen in FIG. 2, the stiffening element may be provided with a plurality of through openings 34.

The lower wall element 21 defines a forward, lowermost rounded edge portion 35 about which the saw structure may pivot in initiating the movement of the distal end of the chain into the subjacent surface 23. Pivot element 30 further includes an upstanding forward portion 36 which extends to forwardly of the front surface 37 of housing 12. The distal end 38 of the pivot portion 36 defines a turned end carrying the resilient pad 28, as seen in FIG. 2.

Thus, as the bar-carried chain is swung downwardly through the subjacent surface portion 23 in cutting therethrough, the pivotal engagement of the pivot portion 36 progressively moves upwardly along the pivot portion 36 to the final position shown in dotted lines in FIG. 2.

In the illustrated embodiment, the bottom portion 21 of the element 30 is generally flat, thereby providing a limited frictional retention of the saw on the angled surface 23 for further improved facilitated use of the saw structure in effecting the cutting through of the surface portion, as discussed above.

In the illustrated embodiment, the arrangement of the chain bar and base line 22 are preselected to space the distal end of the chain approximately 1" above the surface 23 when the saw structure is placed thereon, as shown in full lines in FIG. 2. Thus, the user may simply pivot the saw structure a small amount to swing the extended saw chain downwardly into the subjacent surface 23 and initiate the desired cutting through thereof, as discussed above.

While the pivot means 18 is shown in the illustrated embodiment as structure mounted to the lower forward portion of the housing of the drive, as will be obvious to those skilled in the art, the pivot means may be formed integrally therein so as to comprise a pivot structure on the lower forward portion of the housing.

As will be further obvious to those skilled in the art, the improved pivot means may be utilized with chain saws wherein the bar-mounted chain extends forwardly at other than the indicated angle to the axis of the drive.

The foregoing disclosure of specific embodiments is illustrative of the broad inventive concepts comprehended by the invention.

We claim:

1. A power saw structure comprising:

powered drive means defining an axis and having manually graspable handle means for orienting said axis in a generally horizontal direction in use, said drive means defining a forward lower portion;

a chain having saw teeth;

a bar projecting forwardly from said drive means at a preselected angle forwardly and downwardly relative to said axis for carrying said chain in use; and pivot means extending downwardly from said drive means forward lower portion for providing a fulcrum on a subjacent surface about which said drive means and bar may be freely swung to urge the distal end of the chain on said forward end of said bar downwardly into the subjacent surface, said pivot means defining a bottom, and said drive means including a housing having a lower rear portion defining with said bottom of said pivot means a base line extending at preselected angle forwardly and downwardly relative to said drive means axis, said distal end of the chain on said bar being spaced a small distance above the base line, whereby when the saw structure is disposed with said rear portion of the housing and the bottom of said pivot means resting on a flat surface, said distal end of the chain is spaced a small distance above said surface to saw into said surface as a result of a small amount of pivoting of the operating saw structure about said pivot means on said surface in such a manner as to raise said rear portion of the housing and lower said distal end of the chain, wherein said pivot means includes an upper end portion disposed forwardly of said drive means for supporting said saw structure on the subjacent surface when the distal end of the saw is caused to extend downwardly through said surface.

2. A power saw structure comprising:

powered drive means defining an axis and having manually graspable handle means for orienting said axis in a generally horizontal direction in use, said drive means defining a forward lower portion;

a chain having saw teeth;

a bar projecting forwardly from said drive means at a preselected angle forwardly and downwardly relative to said axis for carrying said chain in use; and pivot means extending downwardly from said drive means forward lower portion for providing a fulcrum on a subjacent surface about which said drive means and bar may be freely swung to urge the distal end of the chain on said forward end of said bar downwardly into the subjacent surface, said pivot means defining a bottom, and said drive means including a housing having a lower rear portion defining with said bottom of said pivot means a base line extending at preselected angle forwardly and downwardly relative to said drive means axis, said distal end of the chain on said bar being spaced a small distance above the base line, whereby when the saw structure is disposed with said rear portion of the housing and the bottom of said pivot means resting on a flat surface, said distal end of the chain is spaced a small distance above said surface to saw into said surface as a result of a small amount of pivoting of the operating saw structure about said pivot means on said surface in such a manner as to raise said rear portion of the housing and lower said distal end of the chain, further including resilient mounting means for resiliently mounting said pivot means to said drive means.

3. A power saw structure comprising:

powered drive means defining an axis and having manually graspable handle means for orienting said axis in a generally horizontal direction in use, said drive means defining a forward lower portion;

a chain having saw teeth;

a bar projecting forwardly from said drive means at a preselected angle forwardly and downwardly relative to said axis for carrying said chain in use; and pivot means extending downwardly from said drive means forward lower portion for providing a fulcrum on a subjacent surface about which said drive means and bar may be freely swung to urge the distal end of the chain on said forward end of said bar downwardly into the subjacent surface, said pivot means defining as bottom, and said drive means including a housing having a lower rear portion defining with said bottom of said pivot means a base line extending at preselected angle forwardly and downwardly relative to said drive means axis, said distal end of the chain on said bar being spaced a small distance above the base line, whereby when the saw structure is disposed with said rear portion of the housing and the bottom of said pivot means resting on a flat surface, said distal end of the chain is spaced a small distance above said surface to saw into said surface as a result of a small amount of pivoting of the operating saw structure about said pivot means on said surface in such a manner as to raise said rear portion of the housing and lower said distal end of the chain, wherein said pivot means comprises a pair of forward metal sheet members and a stiffening element secured therebetween, said sheet members defining an overlapping double wall portion extending forwardly of said drive means above said forward lower portion thereof and providing a support for said saw structure as said distal end of the chain is passed downwardly through said subjacent surface.

4. A power saw structure comprising:

powered drive means defining an axis and having manually graspable handle means for orienting said axis in a generally horizontal direction in sue, said drive means defining a forward lower portion;

a chain having saw teeth;

a bar projecting forwardly from said drive means at a preselected angle forwardly and downwardly relative to said axis for carrying said chain in use; and pivot means extending downwardly from said drive means forward lower portion for providing a fulcrum on a subjacent surface about which said drive means and bar may be freely swung to urge the distal end of the chain on said forward end of said bar downwardly into the subjacent surface, said pivot means defining a bottom, and said drive means including a housing having a lower rear portion defining with said bottom of said pivot means a base line extending at preselected angle forwardly and downwardly relative to said drive means axis, said distal end of the chain on said bar being spaced a small distance above the base line, whereby when the saw structure is disposed with said rear portion of the housing and the bottom of said pivot means resting on a flat surface, said distal end of the chain is spaced a small distance above said surface to saw into said surface as a result of a small amount of pivoting of the operating saw structure about said pivot means on said surface in such a manner as to raise said rear portion of the housing and lower said distal end of the chain, wherein said powered drive means includes a starter handle means having a large size preselected to permit the safe use of a gloved hand in starting the powered drive means.

* * * * *